US007096640B1

(12) United States Patent
Chevian et al.

(10) Patent No.: US 7,096,640 B1
(45) Date of Patent: Aug. 29, 2006

(54) THERMAL BREAKING SYSTEM FOR CONSTRUCTION MATERIALS AND THE LIKE

(75) Inventors: Martin J. Chevian, Zelienople, PA (US); Mike Manteghi, Cranberry Township, PA (US); Joshua W. Early, Sarver, PA (US); James E. Hulings, Zelienople, PA (US)

(73) Assignee: TRACO, Cranberry Township, PA (US)

( * ) Notice: Subject to any disclaimer, the term of this patent is extended or adjusted under 35 U.S.C. 154(b) by 0 days.

(21) Appl. No.: 10/449,343

(22) Filed: May 30, 2003

(51) Int. Cl.
*E04C 3/30* (2006.01)

(52) U.S. Cl. ..... 52/731; 52/309.13

(58) Field of Classification Search ..... 52/717.02, 52/743, 741, 717.05, 717.1, 204.1, 204.5
See application file for complete search history.

(56) References Cited

U.S. PATENT DOCUMENTS

| | | | | |
|---|---|---|---|---|
| 3,798,869 A | | 3/1974 | Nipp | 52/743 |
| 3,823,524 A | * | 7/1974 | Weinstein | 52/717.02 |
| 3,925,953 A | * | 12/1975 | LaBorde | 52/745.19 |
| 4,342,144 A | | 8/1982 | Doguchi | 29/155 R |
| 4,423,578 A | * | 1/1984 | Meigs et al. | 52/396.04 |
| 4,596,099 A | | 6/1986 | Kaminaga | |
| 4,669,241 A | * | 6/1987 | Kelly | 52/204.597 |
| 4,688,366 A | * | 8/1987 | Schmidt | 52/717.02 |
| 5,022,205 A | * | 6/1991 | Ford | 52/309.16 |
| 5,088,258 A | * | 2/1992 | Schield et al. | 52/204.593 |
| 5,617,695 A | * | 4/1997 | Brimmer | 52/717.02 |
| 5,655,282 A | * | 8/1997 | Hodek et al. | 29/469.5 |
| 5,727,356 A | | 3/1998 | Ensinger et al. | 52/717.02 |
| 5,916,681 A | * | 6/1999 | Cipin | 428/403 |
| 6,033,995 A | * | 3/2000 | Muller | 438/749 |
| 6,405,498 B1 | * | 6/2002 | Riegelman | 52/204.595 |
| 6,412,240 B1 | * | 7/2002 | Treleven et al. | 52/208 |
| 6,432,343 B1 | | 8/2002 | Zollondz et al. | 52/743 |
| 6,485,122 B1 | * | 11/2002 | Wolf et al. | 312/406.2 |
| 6,500,550 B1 | * | 12/2002 | Tsuboi et al. | 428/425.8 |
| 6,633,320 B1 | * | 10/2003 | Sogabe et al. | 347/183 |

FOREIGN PATENT DOCUMENTS

| | | |
|---|---|---|
| DE | 25 43 969 | 4/1977 |
| GB | 2081786 | 7/1981 |

OTHER PUBLICATIONS

"An Alternative Thermal Break" By John Jervis, Window & Door Fabricator, Apr./May 1996, p. 50-51.
"Structural Performance Pured and Debridged Framing Systems" Publication No. AAMA TIR-A8-90, Technical Information Center.

* cited by examiner

*Primary Examiner*—Ramon O. Ramirez
*Assistant Examiner*—Steven Marsh
(74) *Attorney, Agent, or Firm*—Pepper Hamilton LLP

(57) ABSTRACT

The invention comprises a thermal breaking system that can be used in the manufacture of windows, doors, and other building components. The thermal break system comprises first and second portions. Interposed between said portions is a thermal break. The thermal break and the portions define a longitudinal channel in which a thermal barrier is integrally formed. The thermal break can comprise a longitudinal flange to increase its adhesion to the thermal barrier. Further the thermal break can comprise four side walls that define a hollow center or void.

7 Claims, 5 Drawing Sheets

THERMAL BREAKING SYSTEM FOR CONSTRUCTION MATERIALS AND THE LIKE

BACKGROUND OF THE INVENTION

The invention relates to a thermal break for frames of windows, doors, and other building components. Specifically, the invention relates to an thermal break insulating section for aluminum or other metallic windows, doors, and other building components.

According to the American Architectural Manufacturers Association ("AAMA"), improving the thermal performance of glazing systems has become increasingly important in recent years. See Structural Performance Poured and Debridged Framing Systems, Publication No. AAMA TIR-A8-90. There currently exist a number of design options to improve thermal performance. The primary method of improvement has been to include a thermal break in the framing system. A thermal break breaks the continuity of the framing system with the inclusion of a low conductance material thereby reducing conductivity of thermal energy. The reduction of conductivity is beneficial to a building's energy consumption properties. The reduction can also improve the resistance of framing members to condensation or frost formation. Further, the inclusion of a low conductance material providing a break in the framing system can have the desirable effect of improving the acoustical properties of the framing system. The desirability associated with improved acoustical properties is evidenced by the Federal Aviation Administration's program related to the reduction of Airport Nose Compatibility. See FAA Part 150, Airport Noise Compatibility Planning.

A significant segment of thermally broken glazing systems currently available use a thermal break design known in the art as "poured and debridged." With respect to aluminum framing systems, for example, the aluminum exterior and interior framing portions are extruded as one piece. An elastomeric material acting as a thermal break can be poured into an extruded cavity connecting the interior and exterior framing portions of the one piece extrusion. The pouring in of said elastomeric material constitutes the "poured" portion of the "poured and debridged" design. After the elastomeric cured, the extruded bridge connecting the interior and exterior portions of the one piece extrusion is removed. Said removal constitutes the "debridging" aspect of poured and debridged designs. FIG. 1 shows a typical example of the one piece design, while FIG. 2 shows a poured and debridged one piece design. Other aspects of the "poured and debridged" design will be readily appreciated by the skilled artisan and are not specifically referred to herein, however, an explanation of additional relevant aspects of the "poured and debridged" design is provided in the above referenced AAMA publication.

Various problems exist that are associated with the poured and debridged process. For example, one piece designs require a multitude of dies for each desiring variation in the extrusion. Further, often architects and designers prefer to have the exterior portion of the framing system to be painted or anodized a different color from the interior portion of the framing system. To do so requires the manufacturer to take painstaking steps for example, the steps include masking one half of the one piece extrusion during painting or anodizing and then separately painting or anodizing said masked portion a separate color. Further, the debridging of one piece extrusion generates a great deal of waste. In the case of aluminum systems, high amounts of metal shavings must be discarded. There is also a cost associated with the labor needed to perform the debridging process. Further, the width of the thermal break is limited to the width of saw blades able to debridge one piece extrusions. Thus, limitations associated with saw blade widths translate into limitations of the width of the debridging cut, and ultimately, the width of the thermal break. Still further, the saws and other equipment necessary in the debridging process have a high cost of upkeep, and when being repaired, result in down time in the manufacturing of windows, doors, and other construction components.

As an alternative to poured and debridged systems, it is known to take two separately extruded portions (e.g. interior and exterior portions) of a framing system and join them through the use of a pre-manufactured polyamide plastic strip having glass fibers impregnated therein. Said strips provide the thermal break. However, those systems and methods still conduct thermal energy. Thus, there exists a need to reduce the thermal conductivity of these systems. There also exists a need to increase the structural properties of those systems. There also exists a need to widen the thermal break to decrease thermal conductance and to increase acoustical properties. However, to widen the thermal break requires that the break be additionally reinforced. This could be done by adding polyurethane or similar material as a reinforcement and a thermal barrier. However, polyurethane, as an example, binds poorly to polyamide plastic strips of the type mentioned above. It would be desirable to be able to provide a thermal barrier, polyurethane for example, in conjunction with a thermal break, the thermal barrier providing the structural reinforcement necessary for adding width to the thermal break. The greater widths that could be achieved decrease thermal conductance and increase the acoustical properties of the thermal break system.

SUMMARY AND OBJECTS OF THE INVENTION

The invention comprises a thermal breaking system that can be used in the manufacture of windows, doors, and other building components. The thermal break system comprises first and second portions. Interposed between said portions is a thermal break. The thermal break and the portions define a longitudinal channel in which a thermal barrier is integrally formed. The thermal break can comprise a longitudinal flange to increase its adhesion to the thermal barrier. Further the thermal break can comprise four side walls that define a hollow center or void.

It is an object of the invention to provide a thermal barrier, in conjunction with a thermal break, the thermal barrier providing the structural reinforcement necessary for adding width to the thermal break and where the thermal barrier strongly adheres to the thermal break.

It is another object of the invention to decrease the thermal conductivity in a thermal break system.

It is another object of the invention to increase the acoustical properties of building components, particularly windows, having a thermal break.

It is still another object of the present invention to eliminate the need of "pouring and debridging" to achieve a thermal break.

It is still yet an another object of the invention to reduce the number of dies necessary for extruded building components by providing for interchangeable extruded portions rather than one piece extrusions.

It is another object of the invention to allow for thermally broken building components to have portions of different color or texture without first painting the whole and then masking, and then separately painting the portion for which different texture is desired.

It is yet another object of the invention to eliminate waste caused by the "poured and debridging" process.

It is still yet another object of the invention to reduce the cost and amount of labor necessary to provide a thermal break and to eliminate the cost associated with upkeep of materials and equipment used in providing a thermal break.

It is a further object of the invention to allow for variations in the width of a thermal break by eliminating the dependence of width on the width of the debridging saw blade or cutting device.

It is still a further object of the invention to increase the surface area of the thermal break to which a thermal barrier, such as polyurethane, can bond.

DESCRIPTION OF THE PREFERRED EMBODIMENT

Figure 1:
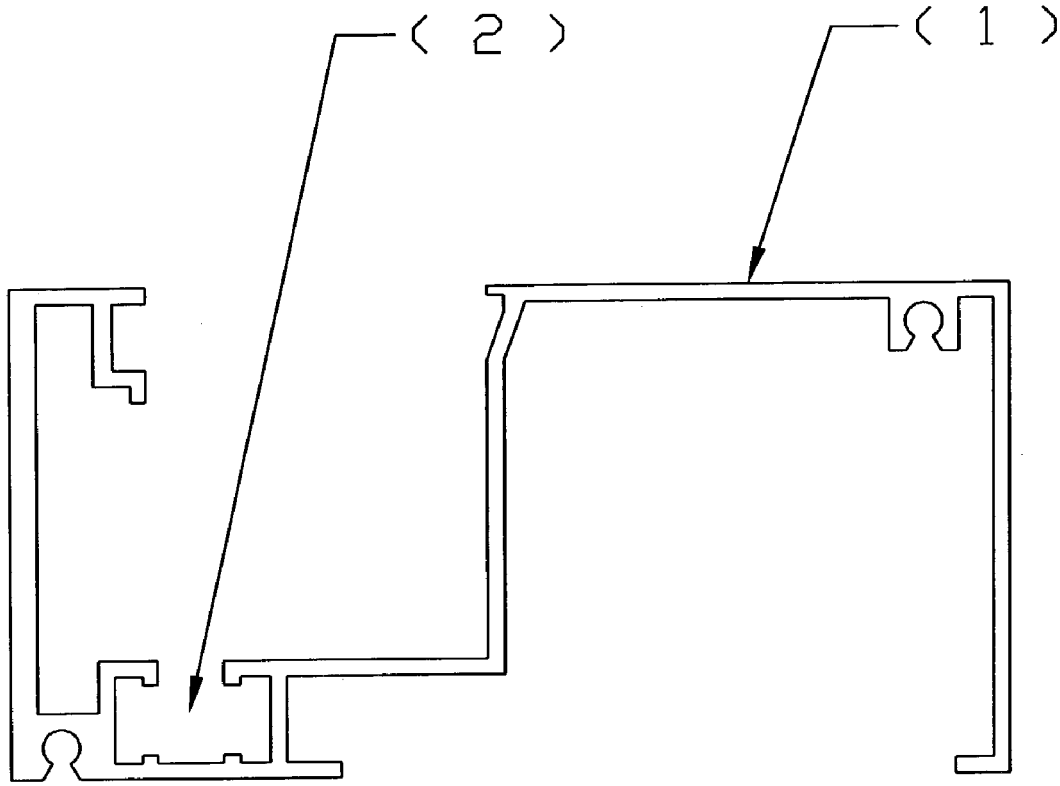
FIGURE 1 PRIOR ART
FIGS. 1 and 2 show cross sections of the poured and debridged system in the prior art which is discussed above.
Figure 2:
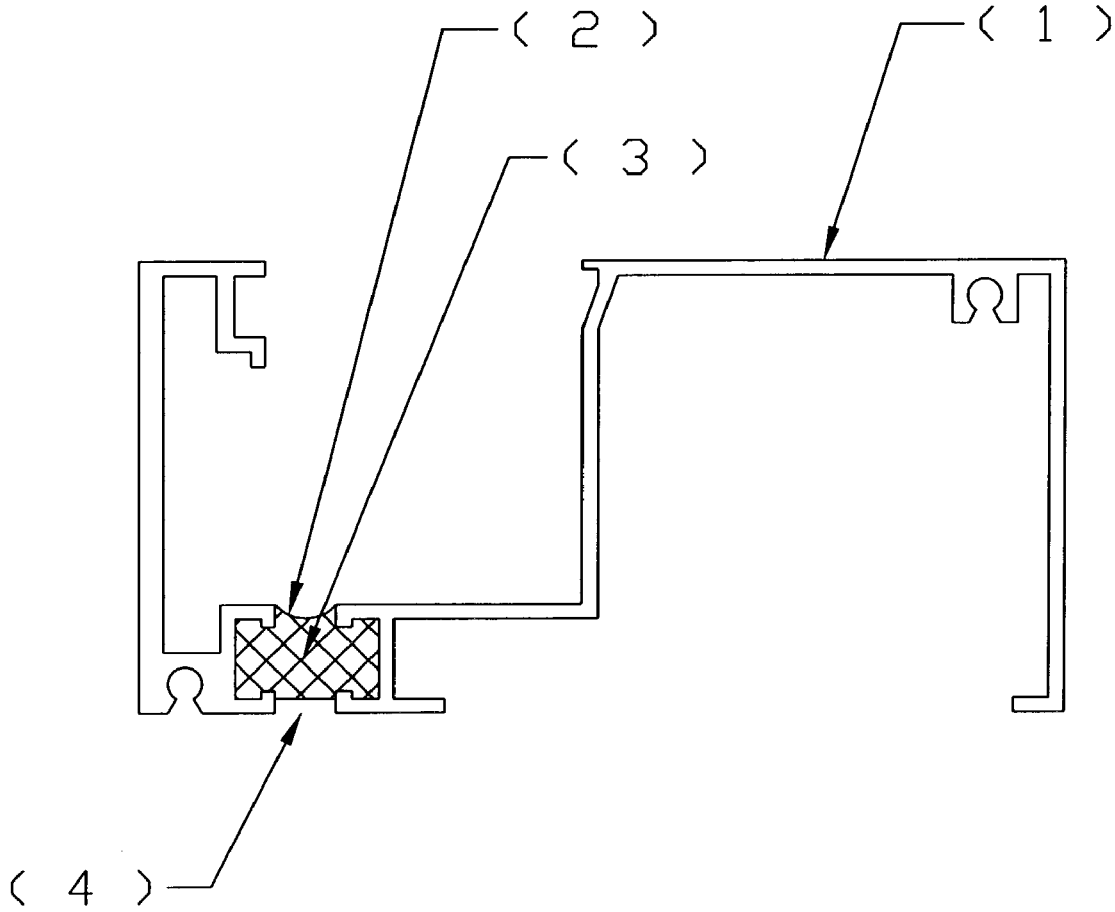
FIGURE 2 PRIOR ART
Figure 3:
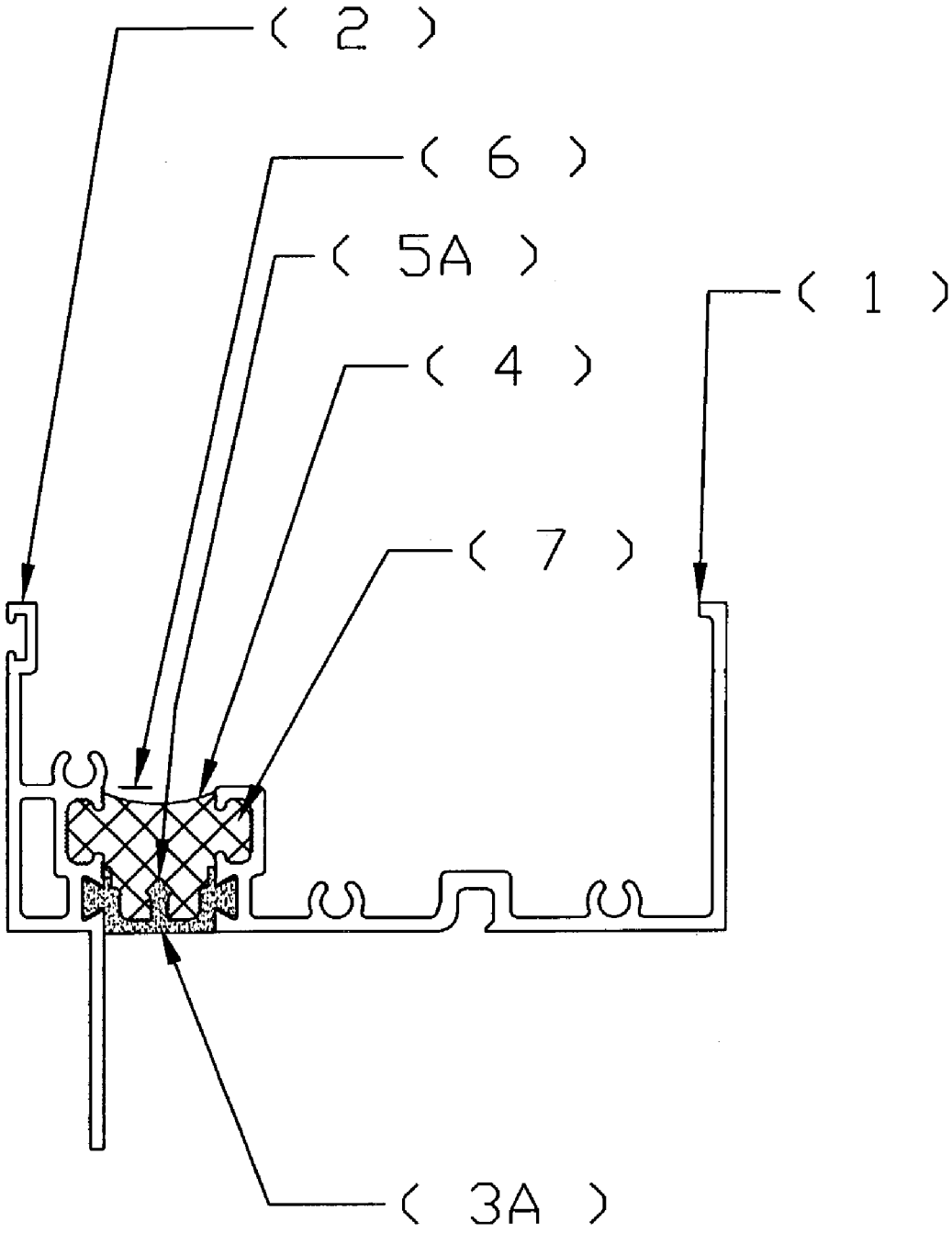
FIGS. 3, 4 and 5 show cross sections of alternate embodiments of the invention.
Figure 4:
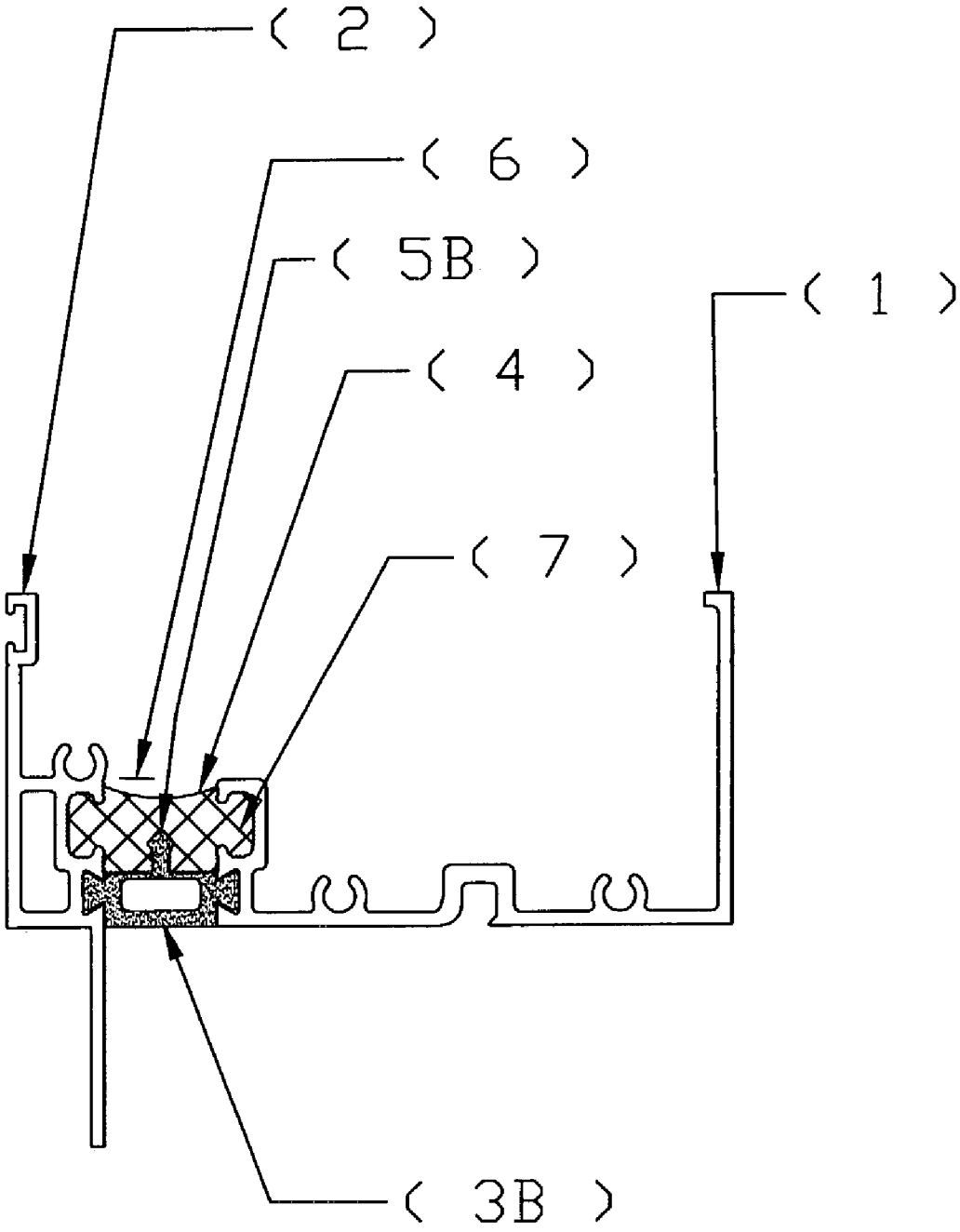
Figure 5:
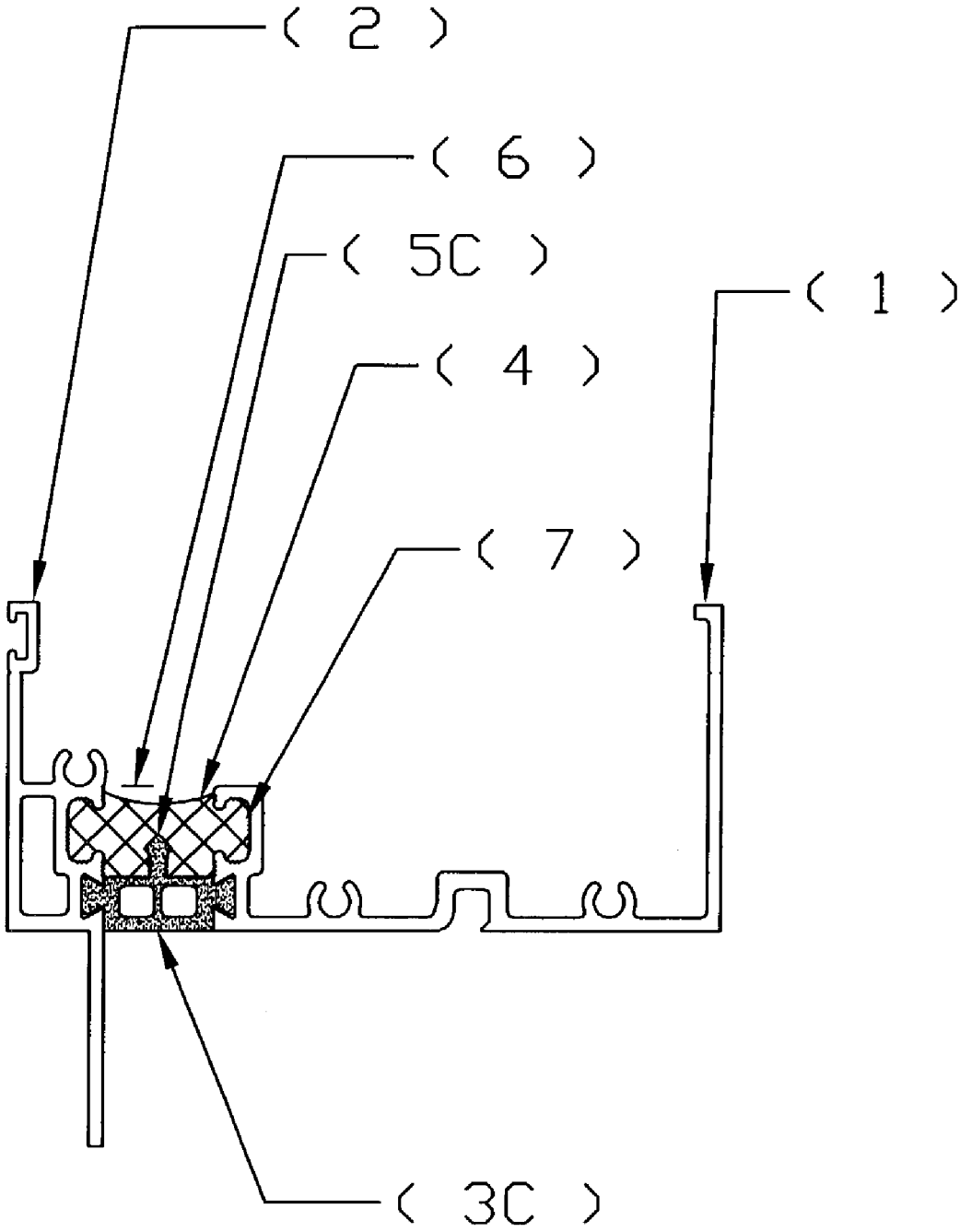

FIGS. 3, 4 and 5 show cross sections of a composite section that can be used in the manufacture of windows, door, and other construction and building components.

In the preferred embodiment, the thermal break system is made of a first (1) and a second (2) portion. Said portions can be made of, for example, aluminum or an aluminum alloy. Said portions correspond to the selections of the building component, i.e., windows, doors, etc., for which an interruption in the continuity of the building component is desired. Said interruption, of course, confers the benefit of lowering thermal conduction and enhancing the acoustical properties of the building components.

Interposed between said first and second portions is a thermal insert (3A, B, C). The thermal insert is preferably made of a PVC, but can be made of nylon, polyamide, or fiberglass. The thermal insert is interposed between the first and second portions to define a longitudinal channel (6) having an opening. Preferably, said insert is frictionally connected to said portions by way of a tongue and groove configuration (7). However, it will be appreciated that the thermal insert may be connected to said portions by means of an adhesive, by the inserts having notches or nodes corresponding to depressions in each of said portions whereby the thermal section placed between said portions and said portions are knurled. In a preferred embodiment, the thermal insert has a longitudinal flange (5A, B, C) protruding the direction of the opening of the longitudinal channel. The flange increases the surface area of the thermal insert to which the thermal barrier (4) adheres, thereby increasing the adhesion strength of the thermal barrier to the thermal insert. The thermal barrier is to be integrally formed within the channel. More preferably, the thermal insert further comprises four side walls defining a hollow center, the hollow center space running the length of the insert. This embodiment of the thermal insert is shown at (3B) in FIG. 4. The hollow center space reduces thermal conductance further and further increases the acoustical properties of the system. In the embodiment, wherein the thermal insert is comprised of four side walls defining a hollow center space, it is preferable to provide the longitudinal flange, as depicted by (5B) in FIG. 4, on the side wall facing the opening in the longitudinal channel such that the flange protrudes in the direction of the opening that remains in the longitudinal channel. FIG. 5 shows another embodiment wherein a thermal insert (3C) further comprises a reinforcing member formed integrally within said hollow space.

Formed integrally in the longitudinal channel is the thermal barrier (4). The thermal barrier, in a preferred embodiment, is made of polyurethane and occupies the space of the channel such that it comes in contact with and is integral with the first (1) and second (2) portion and the wall of the thermal insert that faces the channel (6) opening. In a preferred embodiment, the thermal barrier is formed integrally by pouring elastomeric material, more preferably polyurethane, in said channel in an amount to fill the channel. Once hardened, the elastomeric material or polyurethane acts as a thermal barrier to reduce thermal conductance between said portions and to increase the acoustic properties. The width and volume of the thermal barrier can be varied by altering the distance between the first and second portions or the depth of the longitudinal channel. In this way, the invention possesses the desirable characteristics of being able to be widened at-will, and in a way that is not dependent on the width of the debridging saw blade, as is the case in poured and debridged systems. The distance of the thermal break (which is the distance between the points where the first and second portions contact the thermal insert, or in other words, the width of the thermal insert) can be from ⅛ to 1 inch and is preferably ½ inch. In an embodiment using polyurethane, the polyurethane strongly adheres to the thermal insert and the first and second portions to the point of becoming integral or substantially integral therewith. By substantially integral it is meant the thermal barrier adheres very strongly with the thermal insert and the first and second portions and is formed into, and occupies, the space of the longitudinal channel. However, the skilled artisan will of course appreciate that in some cases, with sufficient labor, the barrier could be removed or separated from the first and second portions.

While presently preferred embodiments have been described and shown, the invention may be otherwise embodied within the scope of the appended claims.

What is claimed is:

1. A thermal break system comprising:

a. a first portion;

b. a second portion;

c. a thermal insert comprising four walls that define a longitudinal space and a reinforcing member formed integrally within a hollow space formed by said four walls, said thermal insert interposed between said first and second portions to define a longitudinal channel therebetween; and d. a thermal barrier integrally adhered to said thermal insert, a shape of said thermal barrier being complementary to a shape of said channel such that said thermal barrier substantially occupies said channel;

wherein said thermal insert separates said first portion and said second portion to reduce thermal conductance.

2. A thermal break system comprising:

a. a first portion;

b. a second portion;

c. a thermal insert comprising at least one longitudinal flange member, said thermal insert interposed between said first and second portions to define a longitudinal channel therebetween; and d. a thermal barrier integrally adhered to said thermal insert and to said longitudinal flange member, a shape of said thermal barrier being complementary to a shape of said channel such that said thermal barrier substantially occupies said channel;

wherein said thermal insert further comprises four walls and a reinforcing member formed integrally within a hollow space formed by said four walls, and separates said first portion and said second portion to reduce thermal conductance.

3. The thermal break system of claim 1 or 2, wherein said thermal insert has a width of at least about ½ inch.

4. The thermal break system of claim 1 or 2, wherein said first and second portions are made of a material selected from the group consisting of aluminum or an aluminum alloy.

5. The thermal break system of claim 1 or 2, wherein said thermal insert is made of a material selected from the group consisting of PVC, nylon, fiberglass, or polyamide.

6. The thermal break system of claim 1 or 2, wherein said thermal barrier is made of polyurethane.

7. The thermal break system of claim 1, wherein said thermal insert further comprises at least one longitudinal flange member.

* * * * *